United States Patent [19]

Eriksson et al.

[11] Patent Number: 4,566,741

[45] Date of Patent: Jan. 28, 1986

[54] SUPERVISORY DESK

[75] Inventors: Stig Eriksson; Bengt Granberg; Erik Westberg, all of Västerås, Sweden

[73] Assignee: ASEA Aktiebolag, Västerås, Sweden

[21] Appl. No.: 692,340

[22] Filed: Jan. 18, 1985

Related U.S. Application Data

[62] Division of Ser. No. 413,827, Sep. 1, 1982, abandoned.

[30] Foreign Application Priority Data

Sep. 4, 1981 [SE] Sweden ..... 8105258
May 3, 1982 [SE] Sweden ..... 8202760

[51] Int. Cl.[4] ..... A47B 17/02

[52] U.S. Cl. ..... 312/194; 108/7; 108/10; 108/138; 108/147; 248/371; 312/231

[58] Field of Search ..... 108/138, 147, 20, 7, 108/39, 3, 4, 5, 6, 143, 1, 2, 8, 9, 10, 64, 65; 312/194, 195, 196, 239, 231; 248/188.2, 371, 138

[56] References Cited

U.S. PATENT DOCUMENTS

| | | | |
|---|---|---|---|
| 702,035 | 6/1902 | Shaffer | 108/1 X |
| 809,960 | 1/1906 | Kundtz | 312/194 X |
| 928,185 | 7/1909 | Dey | 312/194 X |
| 1,979,363 | 11/1934 | Berkeley | 108/20 X |
| 2,560,679 | 7/1951 | Zalkind | 108/9 X |
| 3,060,624 | 10/1962 | Wenger | 108/7 |
| 3,080,835 | 3/1963 | Guglielmi | 108/147 |
| 3,195,482 | 7/1965 | Whitfield | 108/138 |
| 3,273,517 | 9/1966 | Amthor, Jr. et al. | 108/147 |
| 3,304,609 | 2/1967 | Horowitz et al. | 108/138 |
| 3,635,174 | 1/1972 | Ball et al. | 312/194 X |
| 4,270,460 | 6/1981 | Husson | 108/3 |
| 4,365,561 | 12/1982 | Tellier | 108/20 X |
| 4,422,385 | 12/1983 | Rutsche et al. | 312/194 X |
| 4,440,096 | 3/1984 | Rice et al. | 108/747 X |
| 4,469,029 | 9/1984 | Ramond | 108/3 |

FOREIGN PATENT DOCUMENTS

| | | | |
|---|---|---|---|
| 652576 | 9/1964 | Belgium | 108/7 |
| 813763 | 5/1969 | Canada | 108/7 |
| 375968 | 7/1922 | Fed. Rep. of Germany | 108/147 |
| J 7388 | 3/1956 | Fed. Rep. of Germany | 108/147 |
| 1429460 | 11/1968 | Fed. Rep. of Germany | 312/194 |
| 2327029 | 12/1973 | Fed. Rep. of Germany | 108/138 |
| 2816849 | 10/1979 | Fed. Rep. of Germany | 108/147 |
| 3107207 | 4/1982 | Fed. Rep. of Germany | 312/231 |
| 3101628 | 10/1982 | Fed. Rep. of Germany | 312/231 |
| 1001376 | 2/1952 | France | 108/7 |
| 275743 | 9/1951 | Switzerland | 108/147 |
| 205642 | 10/1923 | United Kingdom | 108/9 |
| 1127989 | 9/1968 | United Kingdom | 108/7 |
| 884686 | 11/1981 | U.S.S.R. | 312/231 |

*Primary Examiner*—William E. Lyddane
*Assistant Examiner*—Thomas A. Rendos
*Attorney, Agent, or Firm*—Watson, Cole, Grindle & Watson

[57] ABSTRACT

A supervisory desk comprises a top section with a desk surface, or the like, a stand section with at least one leg of adjustable length which supports the top section so that the height of the top section above the stand section can be adjusted. The leg(s) is/are inclined (e.g. at 45°) to the vertical plane, whereby ergonomic conditions are obtained for an operator using the desk having regard to the height of the desk surface, the leg space below the top section and the view over the rear edge of the desk surface.

5 Claims, 15 Drawing Figures

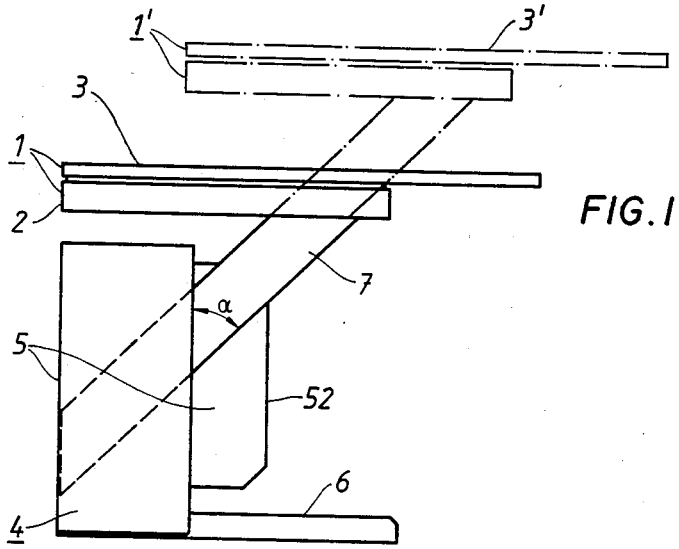
FIG. 1
FIG. 2
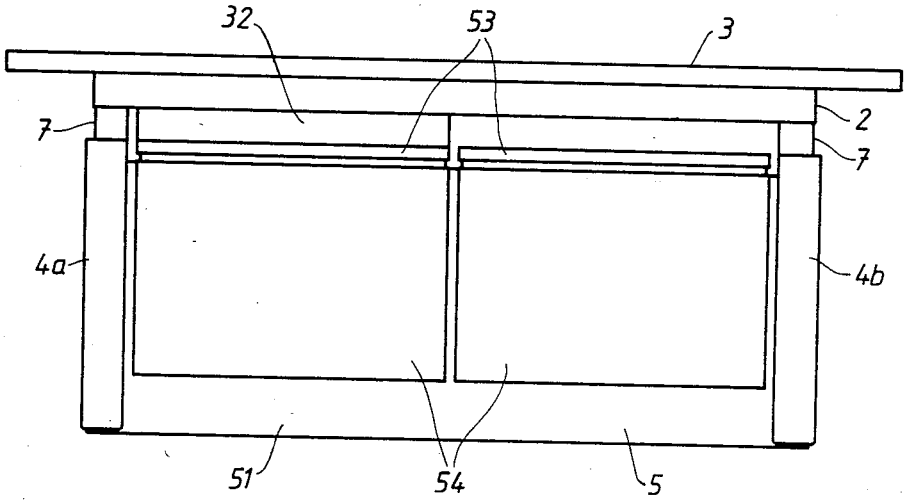

FIG. 6
FIG. 3
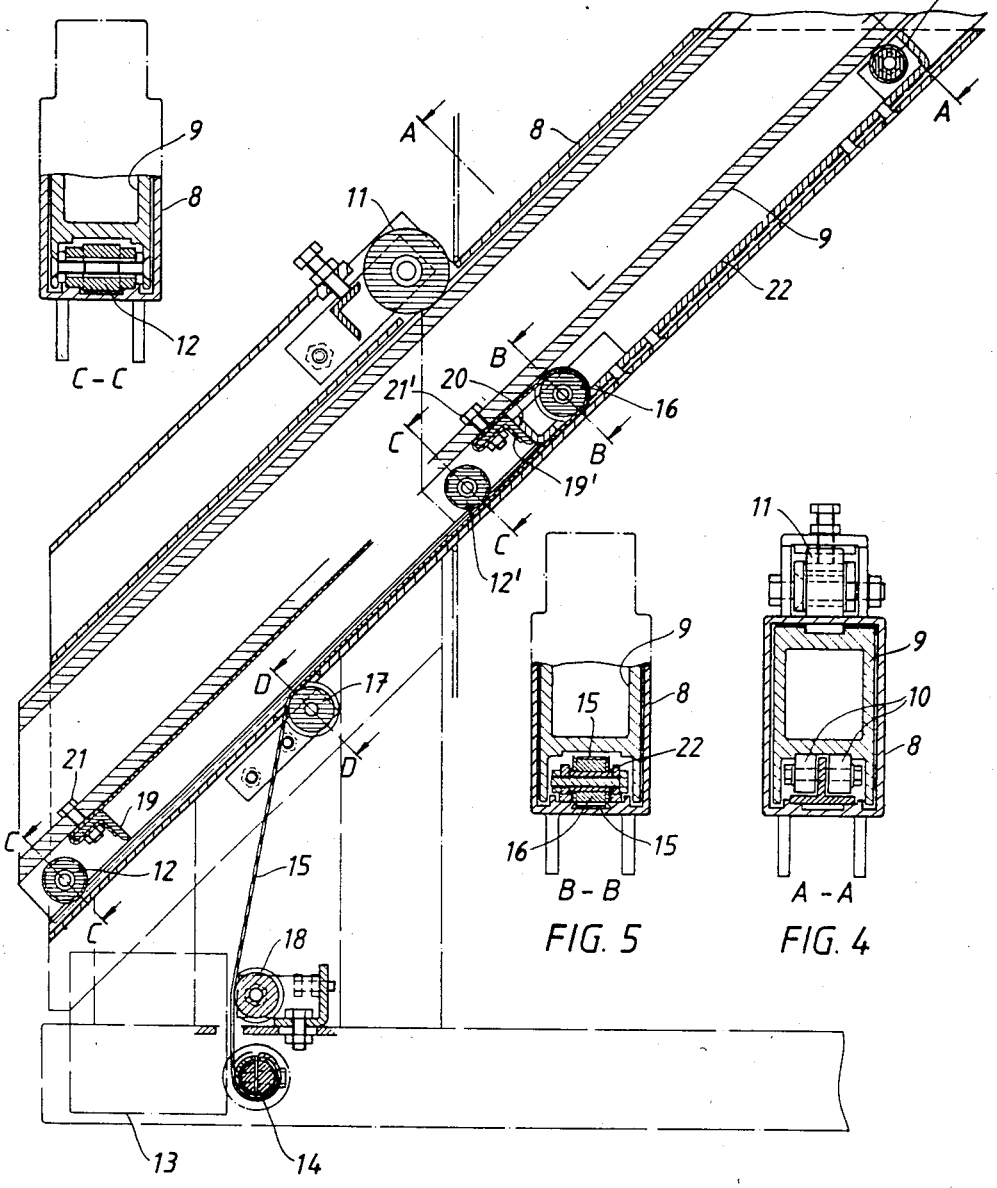
FIG. 5
FIG. 4
FIG. 7
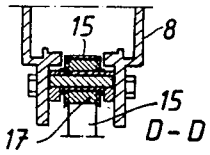

SUPERVISORY DESK

This application is a division of application Ser. No. 413,827 filed Sept. 1, 1982, now abandoned.

TECHNICAL FIELD

The present invention relates to a supervisory desk comprising a top section with a desk surface or the like and a stand section supporting the top section via at least one leg of adjustable length. Desks of this kind are used, for example, for the control of electric power systems and industrial processing plants and commonly incorporate a cabinet which houses electrical equipment, for example for communication between a keyboard, disposed on or in the desk surface, and a computer.

Such supervisory desks are often manned in shifts 24 hours a day. It is therefore desirable for the operating plane of the desk surface to be raisable and lowerable so that it can be easily adjusted to the physical sizes of the different operators who sit at the desk.

Desks of the type to which the invention relates are often used in supervisors cabins overlooking workshops and the like. It is then a requirement that the operator has a good view over the rear edge of the desk, enabling the manufacturing processes in the workshop to be directly supervised from the cabin.

DISCUSSION OF PRIOR ART

It is known to contruct supervisory desks with vertical legs of variable length, so that the vertical position of the desk surface can be adjusted for each different operator. However, with such a design where the desk surface can only be displaced in the vertical direction, it is difficult to achieve, at one and the same desk, both sufficient leg space for tall operators and a good view over the rear edge of the desk for small operators. For reasons of space, among other things, the cabinet of the desk is placed on the floor below the rear edge of the desk top section and is fixedly mounted to the desk stand section. If the horizontal dimension between the cabinet (or terminal section) and the front edge of the desk surface is adjusted to the length of the legs of a tall person, short persons will have a bad view in an oblique downward direction over the rear edge of the desk.

It is one object of the present invention to provide a supervisory desk of the above-mentioned kind, which is ergonomically adapted to the operator with respect to the height of the desk surface, the leg space, and the view over the rear edge of the desk.

STATEMENT OF INVENTION

According to the invention there is provided a supervisory desk comprising a top section having a front edge, a stand section with at least one leg of adjustable length which supports the top section so that the top section may be adjusted in height relative to the stand section, which is characterised in that said at least one adjustable leg is inclined forwardly with respect to a vertical plane in such a way that the front edge of the top section moves forwardly with respect to the stand section when the length of said at least one adjustable leg is increased.

BRIEF DESCRIPTION OF DRAWINGS

A number of embodiments of a desk according to the invention will now be described, by way of example, with reference to the accompanying drawings, in which:

FIG. 1 is a side view of a first embodiment of supervisory desk according to the invention, FIG. 2 is a view from the rear of the first embodiment of desk, FIG. 3 is an axial sectional view of one embodiment of adjustable leg with drive means for a desk according to the invention, FIG. 4 is a cross-section through the adjustable leg of FIG. 3 taken along the line A—A thereof, FIGS. 5, 6 and 7 are partial sections on the lines B—B, C—C and D—D of FIG. 3.

DESCRIPTION OF PREFERRED EMBODIMENTS

Figures 8, 9:
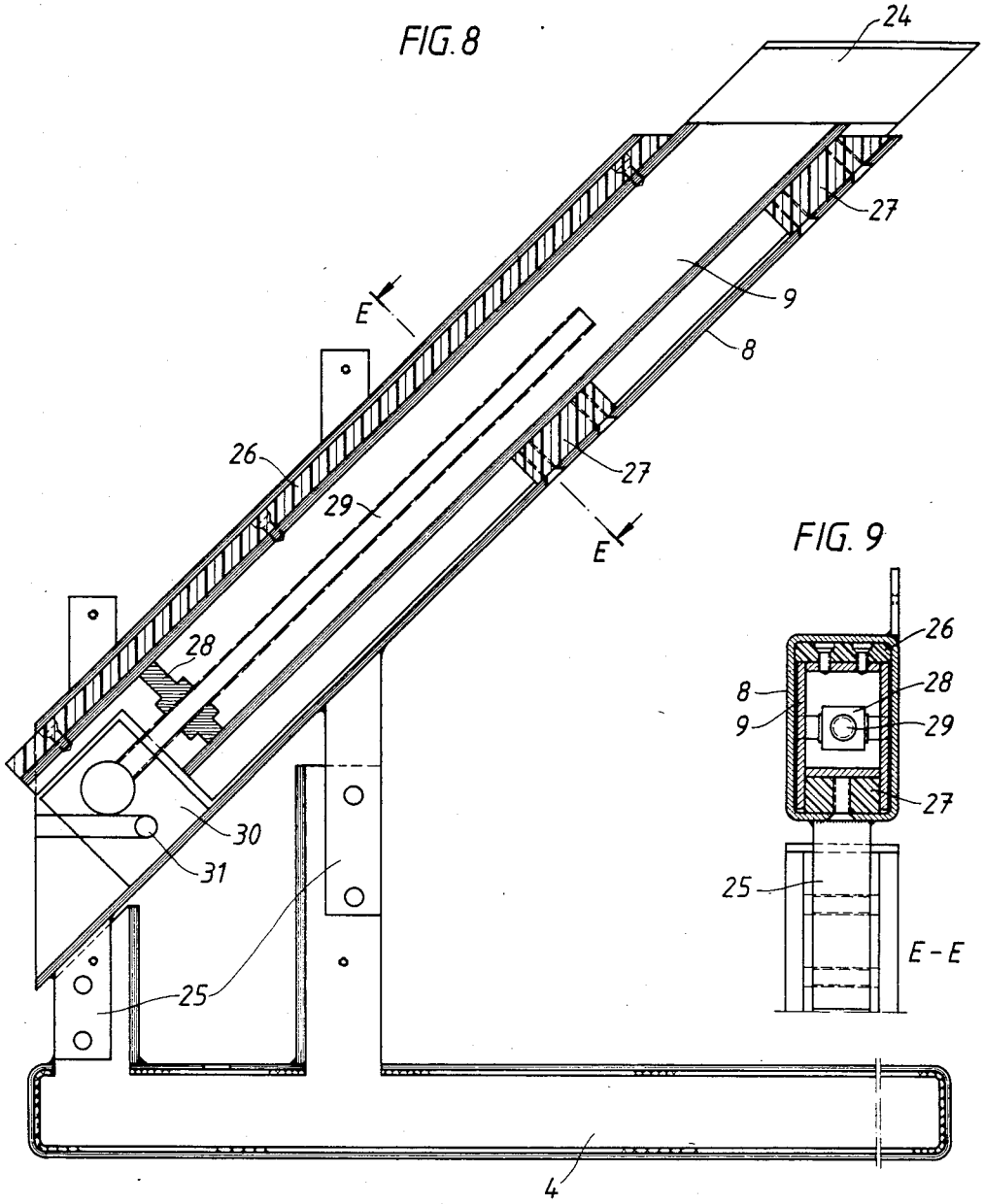
FIG. 8 is an axial sectional view of a second embodiment of adjustable leg with drive means for a desk according to the invention.
FIG. 9 is a cross-section through the adjustable leg of FIG. 8 taken along the line E—E thereof.

The supervisory desk shown in FIGS. 1 and 2 comprises a top section 1, having a support frame 2 and a desk top 3, a. stand section 4, comprising two leg units 4*a*, 4*b* arranged one at each opposite end of the desk, and a cabinet means, or terminal section, 5 disposed between the leg units 4*a* and 4*b*. Each leg unit has a foot 6 and an adjustable leg 7, the length of which may be changed so that the top section 1 can be set at different heights above the feet 6. FIG. 1 shows the top section 1 both in a lower position (unbroken lines) and in an upper position dash-dotted lines and reference numerals with a prime). The terminal section can be a cabinet housing electrical equipment for use by an operator sitting at the desk.

Each adjustable leg 7 is fixed to the respective leg unit 4*a*, 4*b* and is inclined at an angle $\alpha$ with respect to a vertical plane. The angle $\alpha$ is desirably at least 15° and at most 75°. In all the embodiments shown in the drawings, the angle $\alpha$ is 45°, which gives optimum ergonomic operating conditions. However, angles for $\alpha$ in the range 35° to 50° can also be used and this is the preferred range for $\alpha$. With a desk designed according to the invention, two changes of the ergonomic dimensions are obtained with a single adjustment movement, namely, a changed desk top height and a changed available leg space in front of the terminal section 5. At the same time the angle of view and the accessibility of the units located on the desk will be changed flexibly with the operator demands.

The terminal section 5 of the first embodiment of supervisory desk shown in FIGS. 1 and 2 comprises a basic unit 51, the faces 52, 53 and 54 of which consist of easily removable panels of which there may be more than one per face. Such a design makes the terminal section easily serviced. The panels 52 and 54 of the front and rear faces, respectively, may, if necessary, be made relatively deep to provide room for apparatus requiring a large dimension in that direction. One example of such an arrangement is shown in FIG. 1, where the front panel 52 projects forwardly of the stand section 4. The panels 53 on the upper side of the terminal section may form an extension of the terminal section, which could, for example, include a separate indicating section of the desk.

The adjustable legs 7 of the desk, one embodiment of which is shown in more detail in FIGS. 3–7, consists of two tubular leg parts, an outer leg part 8 and an inner leg part 9, both of which have a substantially rectangular cross-section. The inner leg part is telescopically received in the outer leg part. FIG. 3 shows the lower end of the inner leg part, both in the upper limiting position (dash-dotted lines and reference numerals with a prime) and in the lower limiting position (unbroken lines). Three support rollers 10, 11 and 12 are employed to guide the inner leg part within the outer leg part, the rollers 10 and 11 being journalled in the outer leg part and the roller 12 in the inner leg part. The roller 11 is adjustable for setting relative transverse play between the leg parts.

The construction of the leg parts and the manner of their interengagement can be clearly seen from FIGS. 3 to 7 and will not be further described here.

A drive unit for adjusting the height of the desk top comprises a geared electrical motor 13 which drives a shaft 14 around which is wrapped a flexible belt 15. The belt 15 is fixed to the inner leg part 9 by a bolt 21 and its length is adapted to that required when the leg 7 is in its lower limiting position. The direction of movement of the belt is reversed around a deflector roll 16 (journalled in a bracket 22 fixed to the outer leg part 8) and is deflected around deflector rolls 17 and 18 between the roll 16 and the drive shaft 14. The deflector roll 18 is adjustable so that any differences in belt length and attachment of the driving belts 15 at both ends of the desk may be compensated for. The extension of the leg 7 is limited by engagement between a stop bar 19 (secured to the inner leg part 9 by the bolt 21) and an end 20 of the bracket 22. Electrical switches (not shown) can be used to turn off the motor powering the drive unit when the members 19/20 engage one another or as a substitute for the member 19 or 20.

The belt 15 may consist of a synthetic fiber belt or a flexible steel belt, and its relative elongation (linear strain) under the working load should be small. In place of a belt, a rope or a wire could be used. The deflector rolls 17 and 18 may be dispensed with.

With the aid of the drive unit described, the desk top may be raised to any arbitrary position between the lower and upper limiting positions. Lowering of the desk top occurs by reversing the direction of rotation of the shaft 14 and utilizing the weight of the top section 1. The drive unit described may be used in conjunction with gas springs mounted one in the cavity of each inner leg part. Such gas springs may, for example, be used to provide additional lifting power for augmenting the mechanical drive unit. Further, the lowering of the desk top may be facilitated by at least one gas spring which acts in the opposite direction to the belt 15 and serves to overcome starting friction of the inner leg part 9 in the outer peg part 8.

Instead of the design shown in FIGS. 3–7, where a driving belt is used for lifting the desk top, the supervisory desk may, as an alternative, be raised by means of at least one gas spring to its upper limiting position and a driving belt or the like can then be used for pulling the desk top surface down to the desired level.

FIGS. 8 and 9 show another embodiment of adjustable leg 7 for a supervisory desk. This embodiment also employs two tubular telescoping leg parts, an outer leg part 8 and an inner leg part 9, both again having a substantially rectangular cross-section.

The upper end of the inner leg part 9 is provided with an attachment 24 for screwing to the support frame 2, whereas the lower end of the outer leg part 8 is provided with an attachment means 25 for screwing to the stand section 4 and the foot 6. For guiding the inner leg part, two slide bearings 26, 27, for example of tetrafluoroethylene are provided, one bearing 26 being fixed to the inner leg part 9 and the other bearing 27 being fixed to the outer leg part 8.

The drive unit for the adjustable leg in the embodiment of FIGS. 8 and 9 is a purely mechanical system with a drive nut 28 and a rotatable drive screw 29. The drive nut 28 is fixed to the inner leg part 9 and the drive screw 29 is driven via a gear unit 30, which in turn is fixed to the outer leg part 8. The gear unit 30 may, for example, include a worm gear which is driven by an electric motor (not shown) or a bevel gear connected to a handle for manual operation. The necessary drive force can be transmitted to the gear unit via an input shaft 31, and by using a common input shaft for all the legs of the desk, a synchronous extension or retraction of all the legs is ensured.

Instead of the mechanical drive system shown in FIG. 8, a hydraulic system may be used, whereby the gear unit 30 is omitted and the drive screw 29 and nut 28 in each leg 7 are replaced by a double-acting hydraulic piston-in-cylinder unit. The hydraulic cylinders in all the legs of the desk are then fed with pressurized fluid via a hose and a valve from a common electrically-operated hydraulic pump.

It is also possible to use a simple manual drive system for the adjustable legs, each hydraulic piston-in-cylinder unit being replaced by a gas spring balancing the weight of the top section 1 and the desired extension of the legs 7 being mechanically locked by some manual catch means.

Figure 10:
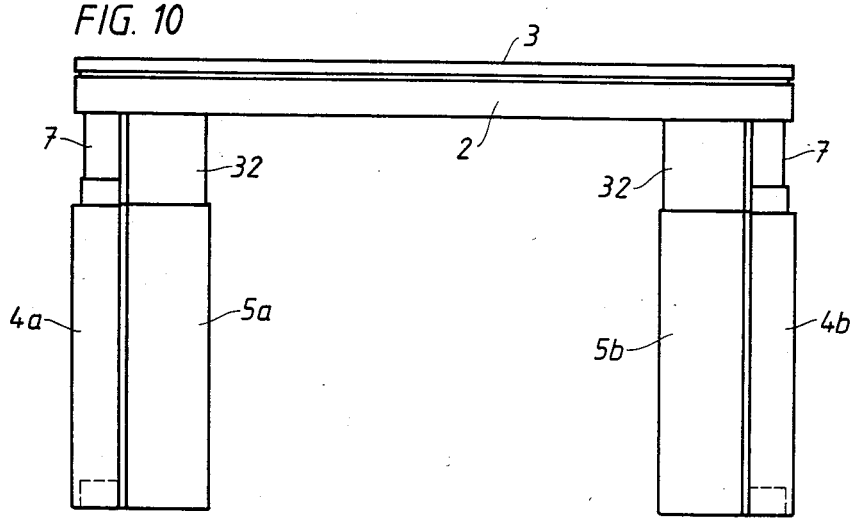
FIG. 10 is a view from the rear of a second embodiment of supervisory desk according to the invention in which the terminal section of the desk consists of two separate units.

FIG. 10 shows an embodiment of a supervisory desk according to the invention where the terminal section 5 consists of two smaller units **5*a*, 5*b*, which are located adjacent to the right-hand and left-hand leg units 4*a*, 4*b***, respectively, and connected to the inner side of the respective leg unit. This embodiment provides greater leg room for an operator sitting at the desk.

Figure 11:
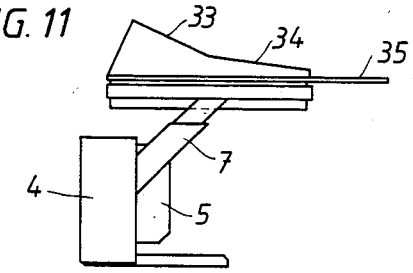
FIGS. 11, 12 and 13 are side views of third, fourth and fifth embodiments of a supervisory desk according to the invention, in which the operating plane, stand, and indicating section of the desk have been extended in different ways.

FIG. 11 shows an embodiment, the upper part of which includes a display panel 33, an operating panel 34 and a writing panel 35.

Figure 12:
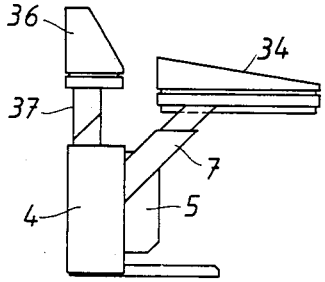

FIG. 12 shows an embodiment with a separate display section 36 which is mounted above the terminal section 5 on a vertical leg 37 of adjustable length, so that the height of the display panel on the section 36 can be adapted to selected height of the operating panel 34.

Figure 13:
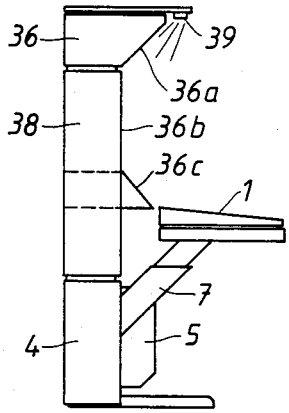

FIG. 13 shows another embodiment again with a separate display section 36, which is supported by two extension legs 38 mounted on the stand sections 4. This embodiment allows an operator a free view of articles beyond the desk through the gap between the display section 36 and the top section 1 of the desk. An indicating panel 36*a* of the display section 36 is illuminated by a light source 39. Instead of spaced-apart extension legs 38, a full cubicle section may be provided below the display section 36 with additional display panels 36*b* and 36*c*.

Figure 14:
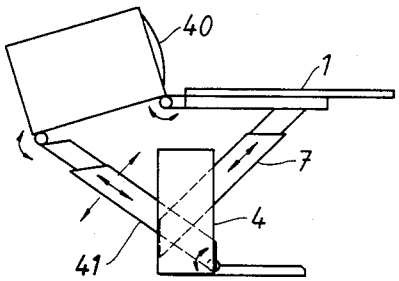
FIG. 14 is a side view of a sixth embodiment of supervisory desk according to the invention with a visual display unit.

FIG. 14 shows an embodiment with a visual display unit 40 which is pivotally mounted on the rear edge of the top section 1 and on a supporting leg 41 of adjustable length which is pivotally mounted at its lower end on the stand section 4. With such a design, a suitable inclination of the visual display unit can easily be obtained for each height position of the top section 1, so as to optimize viewability (e.g. to avoid reflections from light sources).

Figure 15:
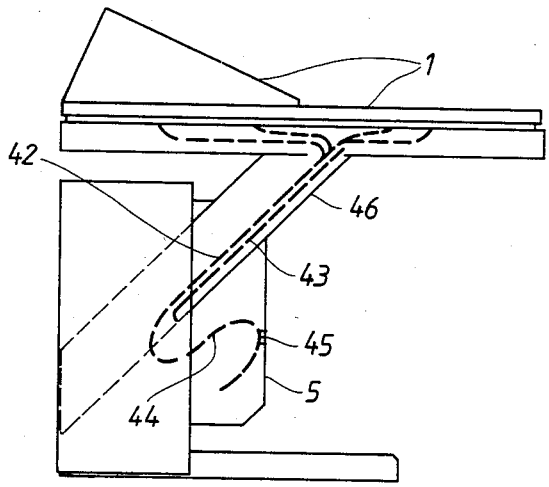
FIG. 15 shows how electrical cables can be arranged to extend between relatively movable sections of a supervisory desk according to the invention.

Between the terminal section 5 and the top section 1 of each embodiment of the desk, cable channels 32 (FIGS. 2 and 10) can be provided. FIG. 15 shows how cables 42 are arranged in these channels and are fixed to a plate 43, which is connected to the top section 1 and moves slavishly therewith. This plate 43 may have a width which is equal to the width of the terminal section 5 or a part thereof. In the terminal section there is arranged a cable slack 44 which is anchored, for example, to a bar 45. In this way, full movement of the adjustable legs, from one limiting position to the other causes only a relatively small movement of the cables 42. The plate 43, with the cables, is surrounded by a protective housing 46, which can be easily dismantled during servicing. Alternatively, instead of the protective housing 46, an easily removable rubber bellows can be used to house the cables 42 which is connected to a connection piece on the underside of the top section 1 and a connection piece on the terminal section 5.

The invention is not limited to the embodiments of desk shown in the drawings and several modifications are clearly feasible. For example, the terminal section 5 need not be employed to house electrical components but may be arranged solely as a protective screen for the operator.

What is claimed is:

1. A supervisory desk, comprising a top section having a front edge, a stand section having at least one leg of adjustable length which supports said top section for adjustment in height thereof relative to said stand section, said at least one adjustable leg inclined in a forward direction relative to a vertical plane at an angle between 15° and 75° such that said front edge of said top section moves in said forward direction relative to said stand section upon an increase in the length of said at least one adjustable leg, and a display unit pivotally mounted on said top section, a support leg of variable length inclined in a rearward direction and having an upper end and a lower end, said lower end pivotally mounted on said stand section, and said upper end pivotally mounted to said display unit.

2. The desk according to claim 1, wherein said angle is between 35° and 60°.

3. The desk according to claim 1, wherein said at least one adjustable leg comprises two substantially coaxial and telescopically displaceable leg parts, one of said leg parts fixedly mounted and forming a guide for the other of said leg parts.

4. The desk according to claim 1, further comprising a drive unit for varying the length of said at least one adjustable leg.

5. The desk according to claim 3, further comprising a drive unit for adjusting the length of said at least one adjustable leg, said drive unit comprising a motor, a shaft drivable by said motor, and a flexible pulling member wrapped about said shaft and fixed at its other end to said one leg part.

* * * * *